US005659899A

United States Patent [19]

Soter et al.

[11] Patent Number: 5,659,899

[45] Date of Patent: Aug. 26, 1997

[54] METHOD OF USING A GLOVE TO OPERATE A SLOT MACHINE

[76] Inventors: Patricia M. Soter; Thomas R. Soter, both of 13 Burbank St., Oxford, Mass. 01540

[21] Appl. No.: 662,926

[22] Filed: Jun. 13, 1996

Related U.S. Application Data

[62] Division of Ser. No. 505,771, Jul. 21, 1995, abandoned.

[51] Int. Cl.[6] ..... A41D 19/00

[52] U.S. Cl. ..... 2/160; 2/159; 902/23; 273/148 B

[58] Field of Search ..... 194/210; 902/23; 273/148 B, 438; 463/20; 2/160, 160.1, 169, 162, 159

[56] References Cited

U.S. PATENT DOCUMENTS

| | | | |
|---|---|---|---|
| 1,252,900 | 1/1918 | Grinnell | 2/169 |
| 1,377,338 | 5/1921 | Grinnell | 2/169 |
| 1,424,072 | 7/1922 | Bosworth | 2/169 |
| 1,643,391 | 9/1927 | McBurney | 2/161.8 |
| 1,774,093 | 8/1930 | Gillian | 2/161.8 |
| 1,820,847 | 8/1931 | Sullivan | 2/162 |
| 2,316,033 | 4/1943 | Walsh | 2/162 |
| 2,447,951 | 8/1948 | Lindfelt | 2/167 |
| 2,496,734 | 2/1950 | Macreadie | 2/160 |
| 2,559,788 | 7/1951 | Patterson | 2/16 |
| 2,710,409 | 6/1955 | Burandt | 2/160 |
| 3,255,462 | 6/1966 | Antonius . | |
| 3,597,765 | 8/1971 | Stanton | 2/159 |
| 4,240,157 | 12/1980 | Peters | 2/167 |
| 4,570,269 | 2/1986 | Berlese | 2/20 |
| 4,670,909 | 6/1987 | Forrester | 2/160 |
| 4,742,578 | 5/1988 | Seid | 2/167 |
| 4,864,660 | 9/1989 | Sawyer | 2/167 |
| 4,908,879 | 3/1990 | Roderman | 2/159 |
| 5,397,125 | 3/1995 | Adams | 463/20 |
| 5,457,306 | 10/1995 | Lucero | 902/23 |
| 5,467,484 | 11/1995 | Drescher et al. | 2/161.6 |

FOREIGN PATENT DOCUMENTS

| | | | |
|---|---|---|---|
| 468296 | 7/1937 | United Kingdom | 2/160 |

*Primary Examiner*—Amy B. Vanatta
*Attorney, Agent, or Firm*—Blodgett & Blodgett, P.C.

[57] ABSTRACT

A slot machine glove is disclosed, which is adapted for use on the hand of a slot machine player. The glove has a front glove portion for covering the palm and the palm side of each digit. The front glove portion is also for extending around the end surface of the tip of each digit, and for covering at least a part of the upper surface of each digit. The front glove portion has a rear peripheral edge, a pair of lateral peripheral edges and a forward peripheral edge. The glove also has a back glove portion, for covering the portion of the back of the hand not covered by the front glove portion. The back glove portion has a rear peripheral edge, a pair of lateral peripheral edges, a forward peripheral edge, and an outer surface. The front glove portion and the back glove portion are joined at their lateral peripheral edges and their forward peripheral edges so that the front glove portion is seamless at the end surface of the tip of each digit. Additionally, the front glove portion is formed of a higher friction material than the back glove portion. Slot machine are gambling deviced which accept coins or currency through slots or like apertures. They may operate by the pulling of a lever, pushing of buttons, or the like.

6 Claims, 8 Drawing Sheets

56
50
36
56
43
51
82
80
18
43
51
52
56
20
56
48
26
PATT!
24
48

10
70
76
36
56
46
56
78
42
22
68
36
82
76
18
44
80
56
44
40
40
24
10
78
56
38
64
22

14
84
82
80
24
42
36
44
18
40
76
56
38
64
78
22
10

50
36
51
43
56
52
20
26
48
PATTI
LLL
70
82
80
14
84
46
68
78
76
24

METHOD OF USING A GLOVE TO OPERATE A SLOT MACHINE

This application is a division of U.S. Ser. No. 08/505,771, filed 21 Jul. 1995, now abandoned.

BACKGROUND OF THE INVENTION

The field of invention relates generally to gloves, and more particularly, pertains to a glove to be worn while operating a slot machine. Slot machines are gambling devices which accept coins or currency through slots or like apertures. They may operate by the pulling of a lever, pushing of buttons, or the like.

Casino gambling has seen an upsurge of interest in recent years. It has proved to be a source of recreational outlet and adventure as people test their luck and hope for the big jackpot.

Slot machines, specifically, have always attracted a large number of gamblers. A slot machine permits the user to expend a smaller amount of money than some of the other casino games, and yet provides the physical involvement of pulling the lever, and the excitement of the sounds and visual images. Also, those that are more shy, or not as familiar with the rules and customs of other casino games, need not feel the pressure of confronting a dealer and gambling as part of a group.

Casinos have further enhanced the fun of slot machines by providing the user with a bonus card. During play, the bonus card is placed in a slot machine bonus card holder, adjacent to the slot machine. This allows for the usage of the gambler to be totalled and recorded, leading to the award of various premiums. The vast majority of casinos, today, use such a system.

However, a well known problem in using a slot machine is that one's hands quickly pick up a characteristic "money" smell and even discoloration. Also, taking the time to frequently wash costs recreational time from the floor of the casino, and costs the casino money for extra cleaning supplies in the lavatories.

Another problem confronted by slot machine users is that the activity of pulling the lever or, pushing the buttons, etc. can lead to broken finger nails, damage to jewelry and even lost stones from rings.

A further difficulty is that, in the middle of the excitement, it is all too easy for a slot machine user to forget the bonus card in the bonus card holder, and walk away to try another machine. This means that the user must either waste time in trying to relocate the original slot machine, or else must have a new card made up.

These and other difficulties experienced with the operation of a slot machine have been obviated in a novel manner by the present invention.

It is, therefore, a principal object of the invention to provide a novel slot machine glove that will add to the recreational aspect of using a slot machine and also serve as a "good luck" charm.

Another object of this invention is the provision of such a slot machine glove that will protect the user's hand from the discoloration and smell that results from the continual handling of coins.

A further object of the present invention is the provision of such a slot machine glove that will help to prevent the loss of the user's bonus card.

It is another object of the instant invention to provide such a slot machine glove that will make it easy for the user to grip coins or the operational parts of the slot machine.

A still further object of the invention is the provision of such a glove that will be lightweight and cool when worn.

It is a further object of the present invention to provide such a glove that will protect fingernails and jewelry from damage and protect against the loss of stones from jewelry.

It is a still further object of the present invention to provide such a glove that will allow a gambling casino to save on the cost of cleaning supplies.

Another object of the invention is the provision of such a glove that will help the user of a slot machine to avoid lost time from the floor to repeatedly wash.

Another object of this invention is the provision of such a slot machine glove that will be washable or dry cleanable.

A further object of the present invention is the provision of such a slot machine glove that is easy and convenient to put on and take off.

It is a further object of the present invention to provide such a glove which is simple in construction, inexpensive to manufacture, and capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

It has now been found that the foregoing and related objects may be readily attained in a slot machine glove which is adapted for use on the hand of a slot machine player.

The glove has a front glove portion for covering the palm and the palm side of each digit. The front glove portion is also for extending around the end surface of the tip of each digit, and for coveting at least a part of the upper surface of each digit. The front glove portion has a rear peripheral edge, a pair of lateral peripheral edges and a forward peripheral edge.

The glove also has a back glove portion, for covering the portion of the back of the hand not covered by the front glove portion. The back glove portion has a rear peripheral edge, a pair of lateral peripheral edges, a forward peripheral edge, and an outer surface.

The front glove portion and the back glove portion are joined at their lateral peripheral edges and their forward peripheral edges so that the front glove portion is seamless at the end surface of the tip of each digit. Additionally, the front glove portion is formed of a higher friction material than the back glove portion.

Preferably, the slot machine glove also includes an elastomeric band attached to both the front glove portion and the back glove portion. The elastomeric band extends along the length of the rear peripheral edge of the front glove portion and along the length of the rear peripheral edge of the back glove portion. This elastomeric band receives the wrist of the slot machine player.

In a preferred embodiment, the slot machine glove is also adapted for use with a slot machine bonus card. The glove includes a pocket which is adapted for receiving the slot machine bonus card. The pocket is positioned on the outer surface of the back glove portion.

Desirably, the slot machine glove includes an elastomeric strap which has a fixed end and a free end. The fixed end is attached to the glove and the free end is adapted to be operatively connected to the slot machine bonus card. A clasp is attached to the free end of the elastomeric strap, for operatively connecting the free end to the slot machine bonus card. Preferably, the fixed end of the elastomeric strap is attached to the elastomeric band and contiguous therewith.

In the preferred embodiment, the front glove portion of the slot machine glove is provided with a plurality of apertures for ventilation. Also, this front glove portion is about 0.5 to 0.9 millimeters in thickness, and preferably about 0.7 millimeters in thickness. The front glove portion is formed of leather, and the back glove portion is formed of an elastomeric material.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
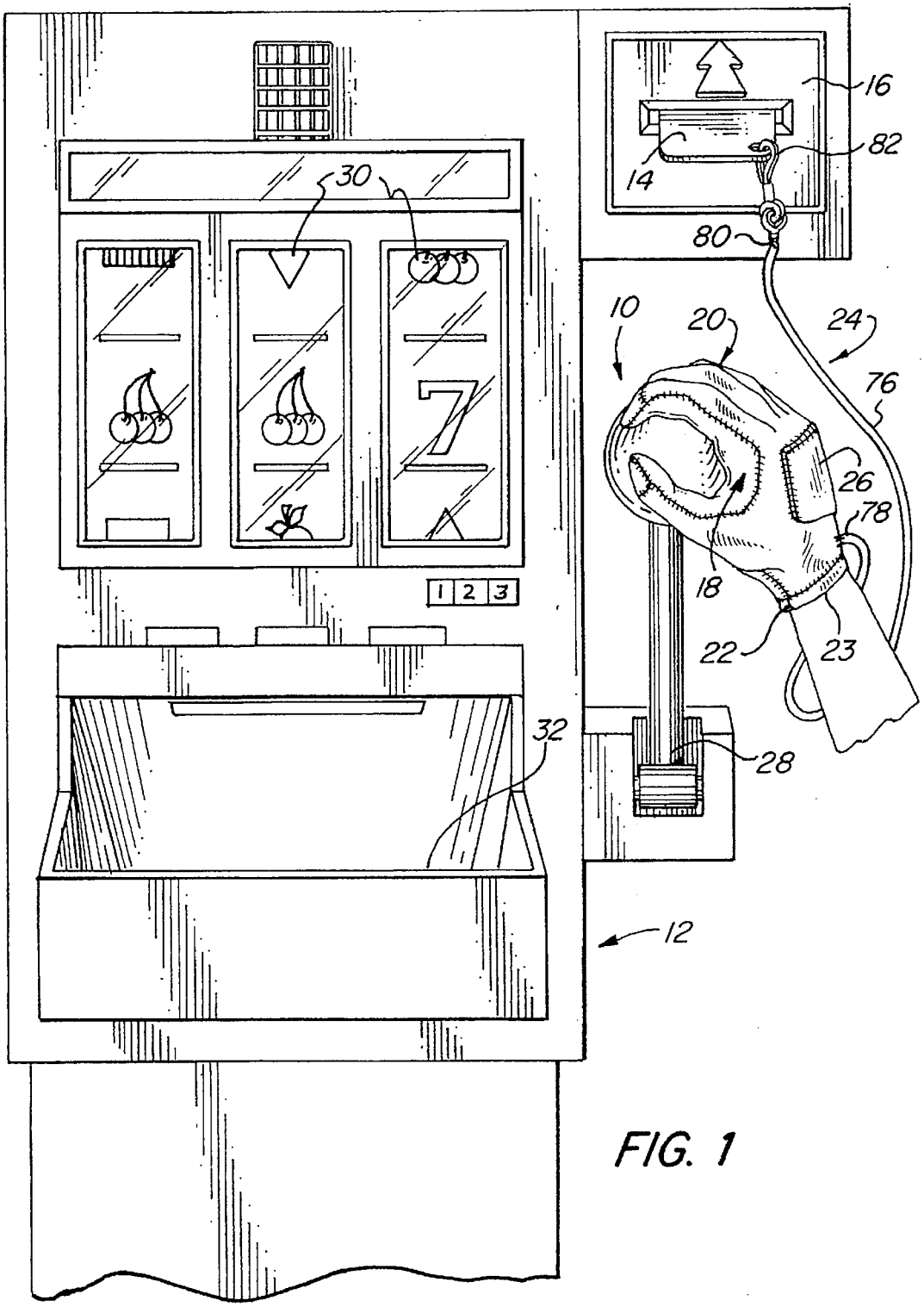
FIG. 1 is a perspective view of a slot machine glove, embodying the principals of the present invention, shown applied to a slot machine, and further showing a slot machine bonus card holder and slot machine bonus card.

With reference now to the drawings, there is shown in FIG. 1, a slot machine glove, embodying the principles of the present invention, and generally indicated by the reference numeral 10. The slot machine glove 10 is used when operating a slot machine, generally indicated by the reference numeral 12, and when inserting a slot machine bonus card 14 into a slot machine bonus card holder 16.

The slot machine glove 10 is shown as having a front glove portion, generally indicated by the reference numeral 18, and a back glove portion, generally indicated by the reference numeral 20. An elastomeric wrist band 22 is shown attached to both the front glove portion 18 and the back glove portion 20 and fits around the user's wrist 23.

An elastomeric strap assembly, generally indicated by the reference numeral 24, is shown as connecting the glove 10 to the bonus card 14, and a bonus card pocket 26, attached to the back glove portion 20, is used for retaining the bonus card 14 when it is not being used.

Referring still to FIG. 1, the slot machine 12 is shown as having a handle 28 for actuating a turn. The results of the turn are shown in the windows 30 and a coin tray 32 provides a receptacle for any coins issued by the slot machine 12.

Figures 2, 3:
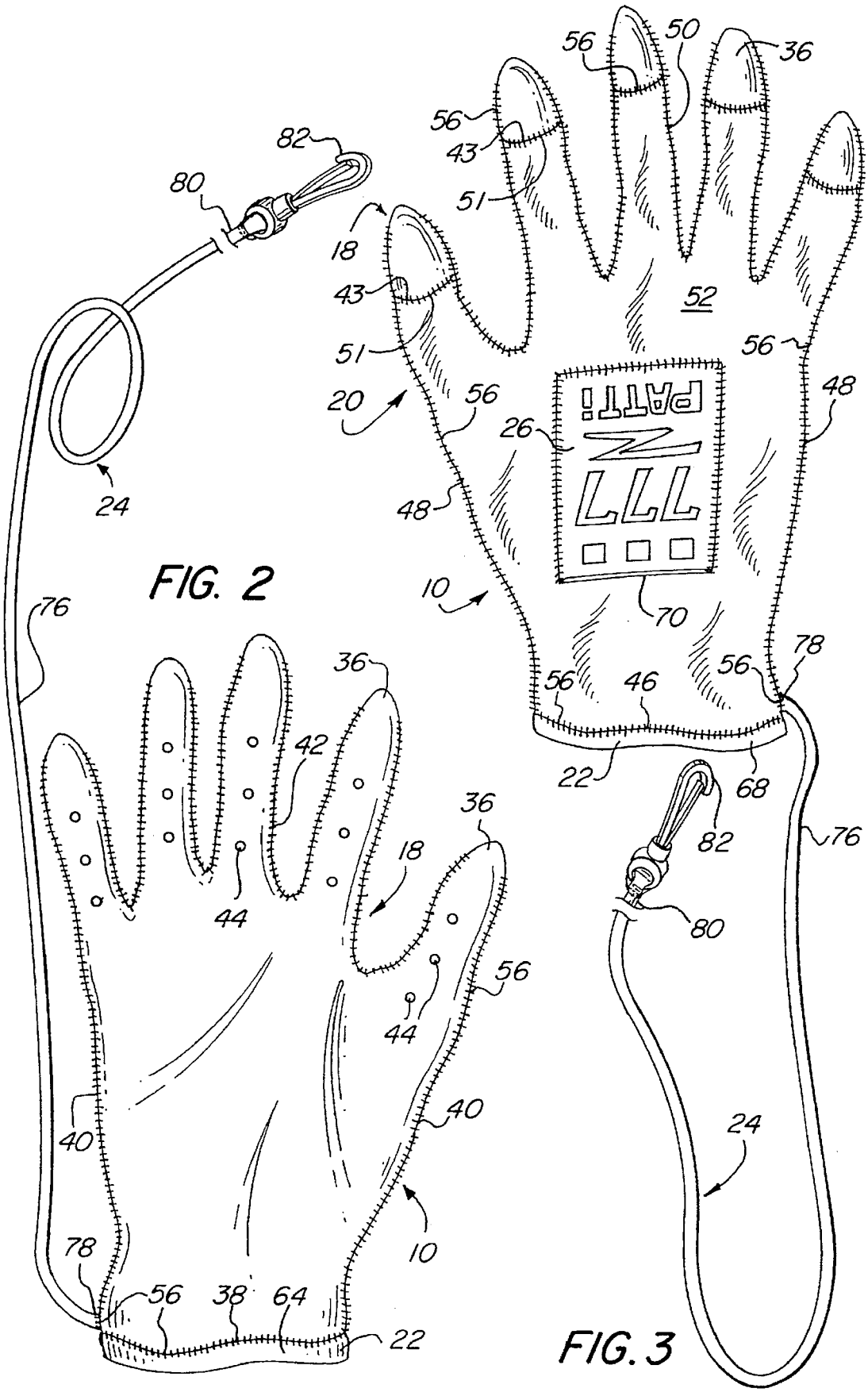
FIG. 2 is a front elevational view of the glove of FIG. 1, showing the front or palm side of the glove.
FIG. 3 is a rear elevational view of the glove of FIG. 1, showing the back side of the glove.

As best shown in FIGS. 2 and 3, the front glove portion 18 covers the palm and the palm side of each of the digits. The front glove portion 18 has a part 36 that extends around the end surface of the tip of each of the digits. The front glove portion 18 also covers at least a part of the upper surface of each of the digits. The part of the upper surface of each of the digits is typically about 1 to 1.5 inches for each digit.

It can be seen that the front glove portion 18 has a rear peripheral edge 38, a pair of lateral peripheral edges 40 and a forward peripheral edge 42. The forward peripheral edge 42 has a distal portion 43 for each digit. Apertures 44, for ventilation, are provided at various locations in the front glove portion 18.

As is best seen in FIG. 3, the back glove portion 20 has a rear peripheral edge 46, a pair of lateral peripheral edges 48, a forward peripheral edge 50, and an outer surface 52. The forward peripheral edge 50 has a distal portion 51 for each digit. The back glove portion 20 covers the portion of the back of the hand not covered by the front glove portion 18.

Figure 12:
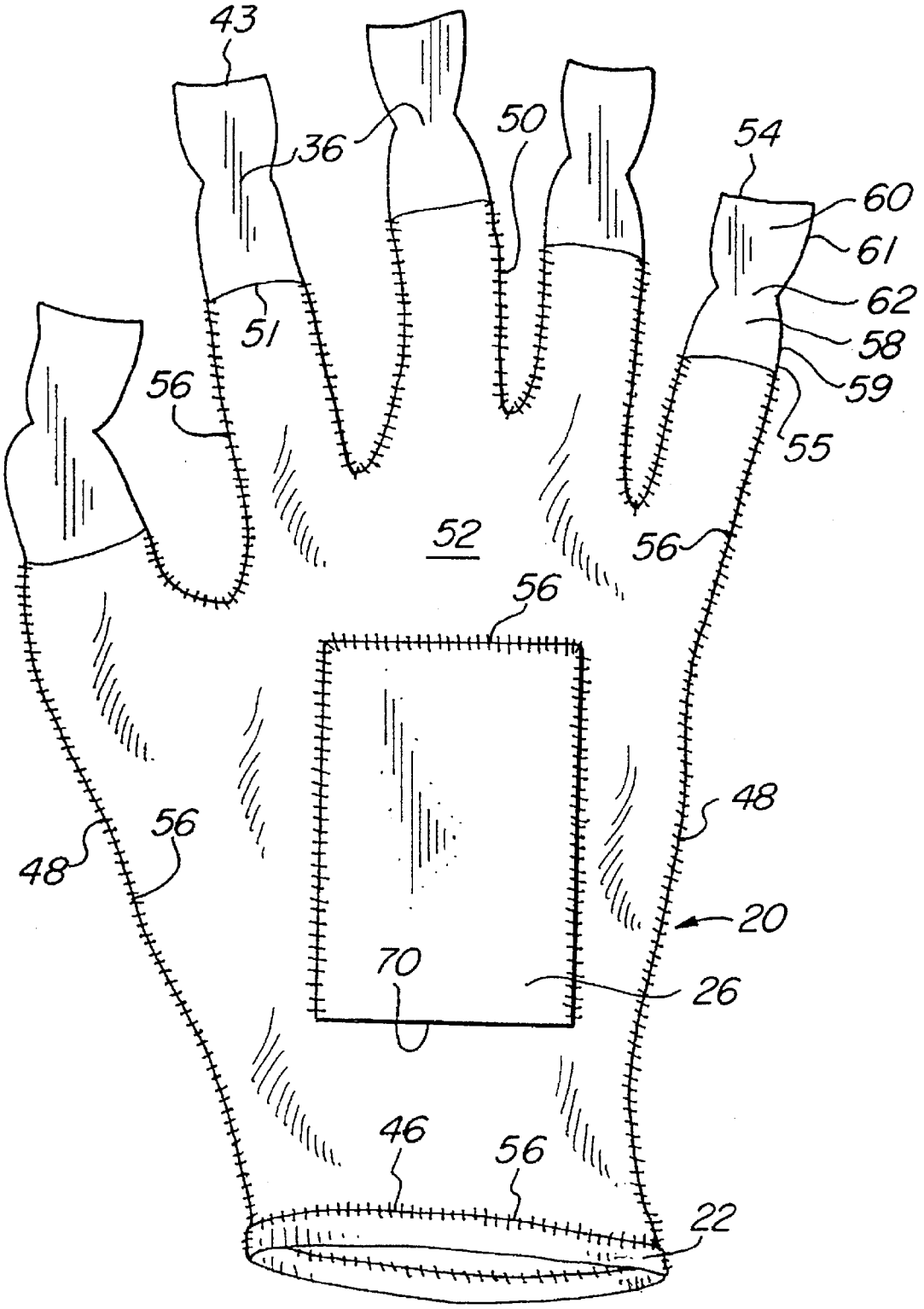
FIG. 12 is a rear elevational view of the slot machine glove, showing the back portion of the glove, and further showing the glove partially assembled.

Referring to FIG. 12, the lateral peripheral edges 48 of the back glove portion 20 overlay the lateral peripheral edges 40 of the front glove portion 18 except at a tip portion 54 of each of a digit portion 55 of the front glove portion 18. The lateral peripheral edges 40, 48 are joined, where they overlay one another, with stitching 56.

Similarly, the forward peripheral edge 50 of the back glove portion 20 overlays the forward peripheral edge 42 of the front glove portion 18, except at a tip portion 54 of each digit portion 55 of the front glove portion 18. The front peripheral edges 42, 50 are also joined, where they overlay one another, with stitching 56.

As best shown in FIG. 12, the tip portion 54 of each digit portion 55 of the front glove portion 18 has a lower tip segment 58 with lateral edges 59 and an upper tip segment 60 with lateral edges 61. The lower tip segment 58 and the upper tip segment 60 are separated by a fold segment 62 which lies within the part 36 that extends around the end surface of the tip of each of the digits.

As can be seen, the lateral edges 59 of the lower tip segment 58 begin to converge as they approach the fold segment 62. Similarly, the lateral edges 61 of the upper tip segment 60 begin to converge as they approach the fold segment 62. The upper tip segment 60 is folded back along the fold segment 62 to overlay the lower tip segment 58. The lateral edges 61 thereby overlay the lateral edges 59, and the lateral edges 59, 61 are joined with stitching 56 (see FIG. 3). In addition, the distal portion 43 of the forward peripheral edge 42 of the front glove portion 18 is joined to the distal portion 51 of the forward peripheral edge 50 of the back glove portion 20 with stitching 56 (see FIG. 3). This construction results in the front glove portion 18 being seamless at the part 36 covering the end surface of the tip of each of the digits (see FIG. 2).

Figure 7:
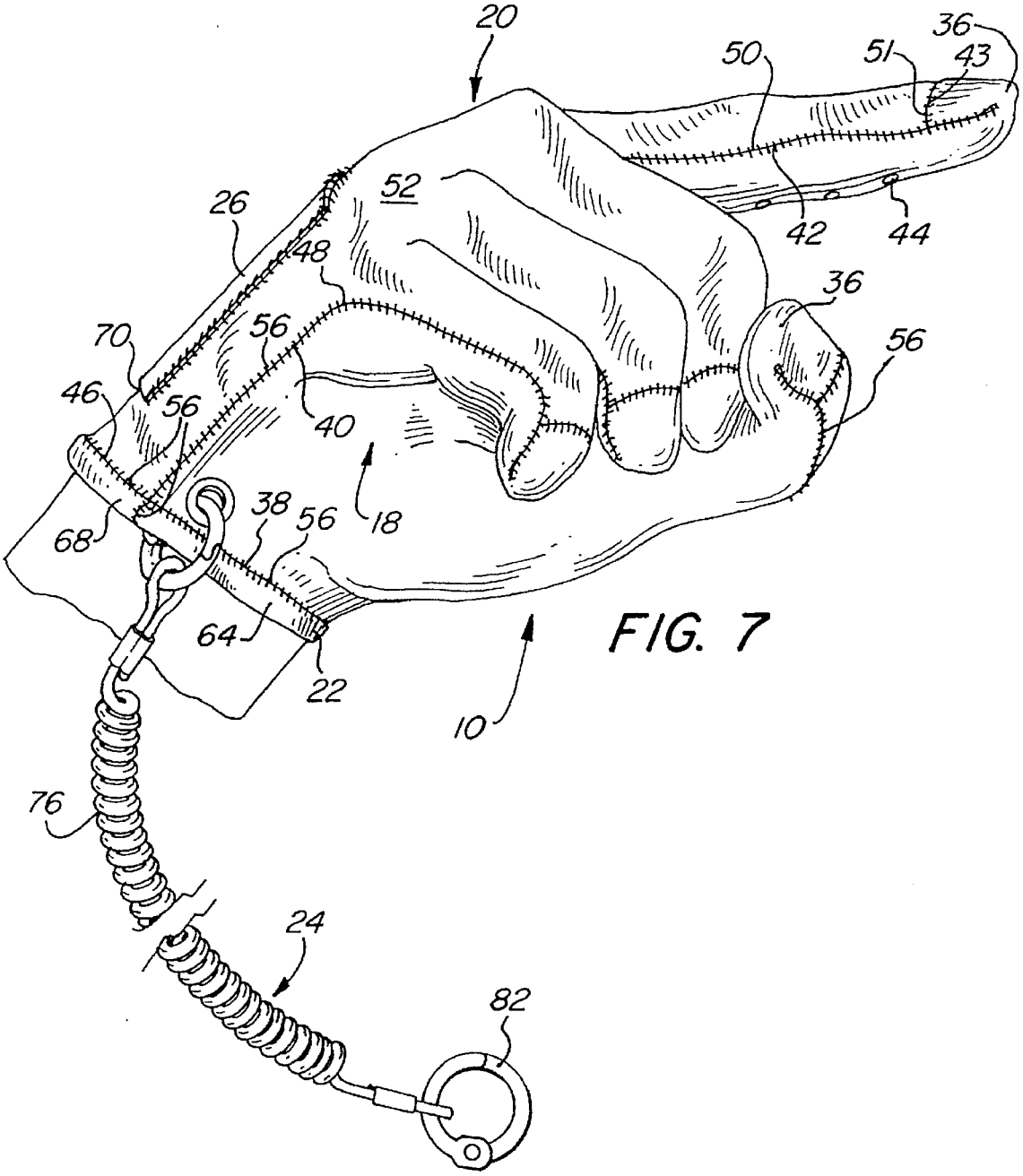
FIG. 7 is a perspective view of the glove of FIG. 1, as seen from the little finger side.
Figure 8:
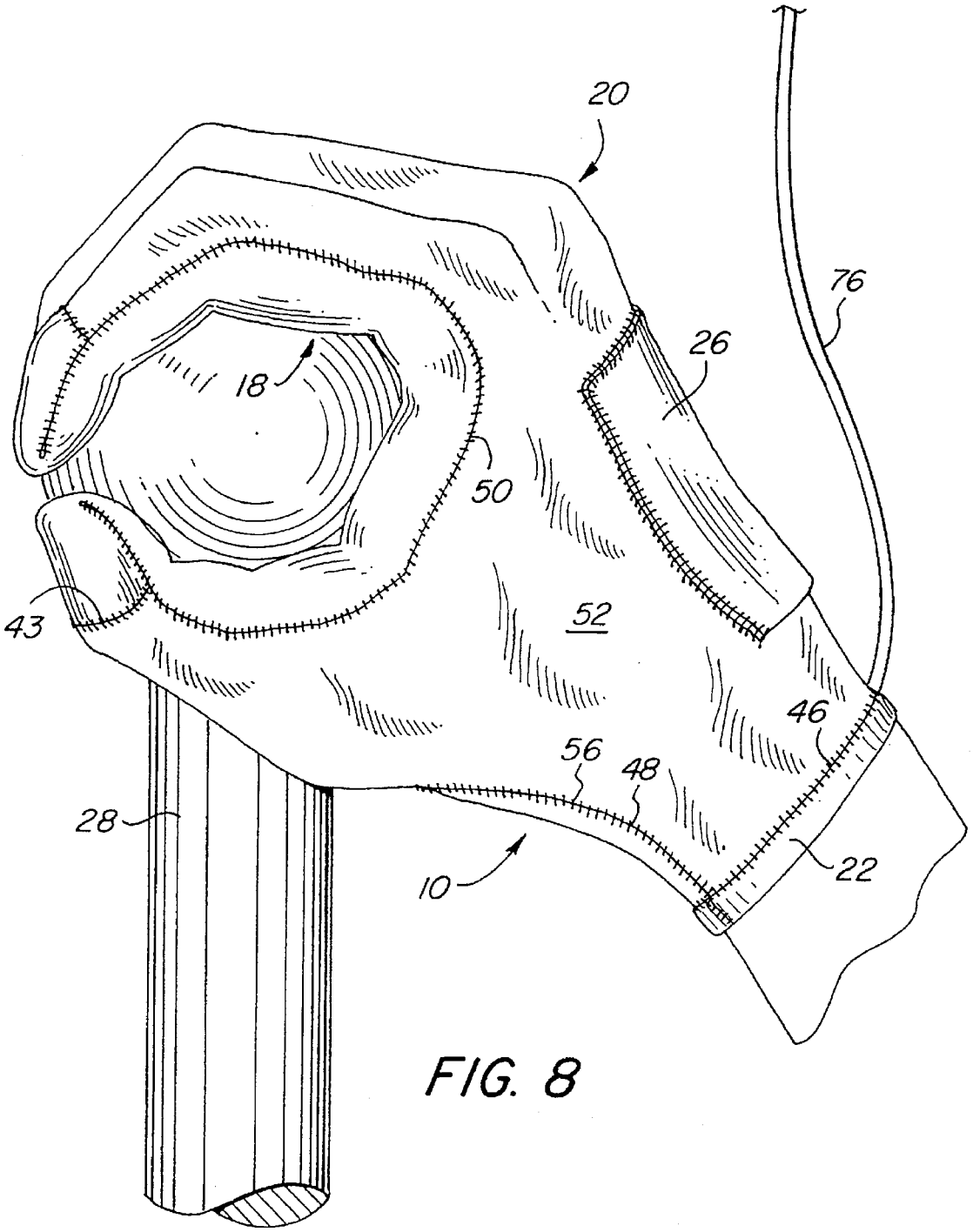
FIG. 8 is a perspective view of the glove of FIG. 1, as seen from the thumb side, and shown grasping the handle of the slot machine.
Figure 10:
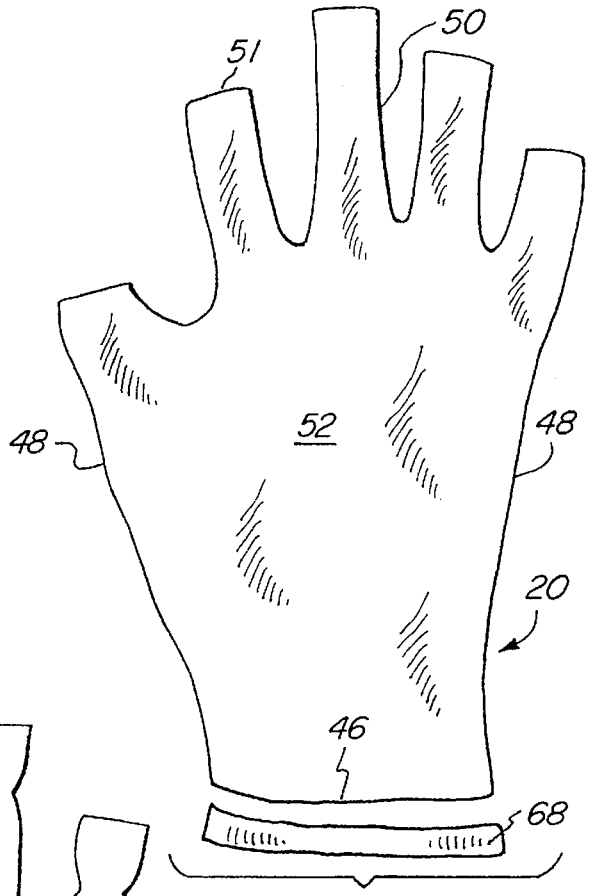
FIG. 10 is a plan view of the back glove portion of the glove of FIG. 1, showing the outer surface of the portion, and further showing the other half of the elastomeric wrist band.
Figure 9:
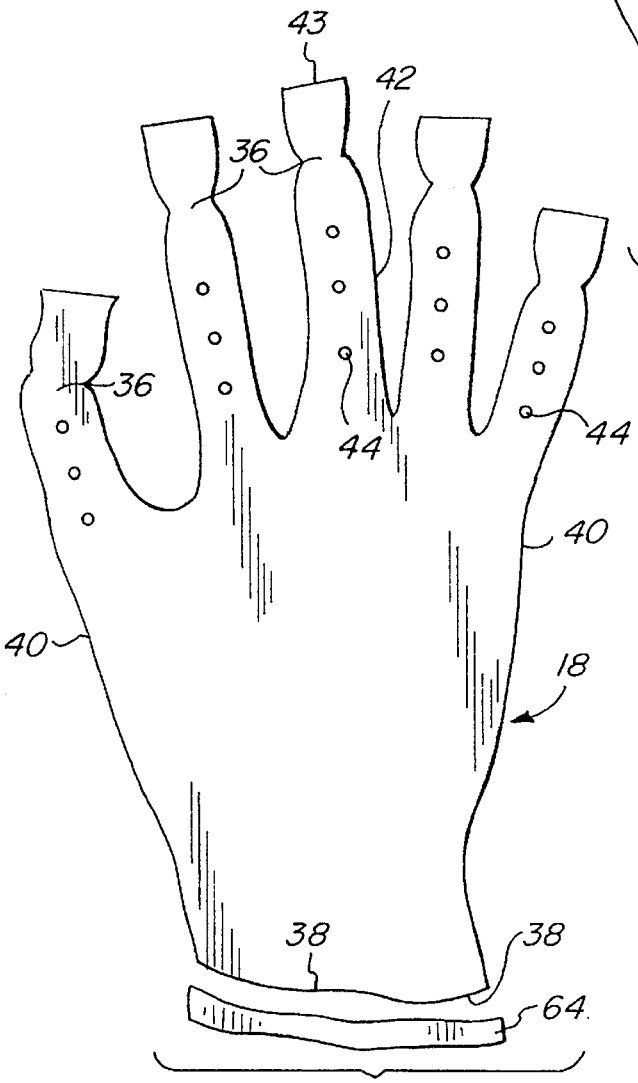
FIG. 9 is a rear elevational view of the front glove portion of the glove of FIG. 1, showing the inner surface of the portion, and further showing one half of the elastomeric wrist band.
Figure 11:
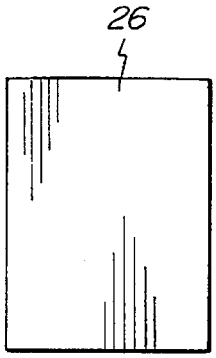
FIG. 11 is a plan view of the bonus card pocket of the glove of FIG. 1, showing the outer surface of the pocket.

Referring to FIG. 7, the elastomeric wrist band 22 is shown as having a first half 64, extending along the length of, and attached to the rear peripheral edge 38 of the front glove portion 18, by means of stitching 56. A second half 68 extends along the length of, and is attached to, the rear peripheral edge 46 of the back glove portion 20, by means of stitching 56.

As shown in FIG. 3, the pocket 26 is attached to the outer surface 52 of the back glove portion 20 by means of stitching 56, on three sides. A fourth side 70 is left unstitched to allow for insertion of the bonus card 14. The pocket 26 is generally dimensioned and configured to allow the bonus card 14 to protrude from the fourth side 70 when the card 14 is fully inserted into the pocket 26.

Figure 4:
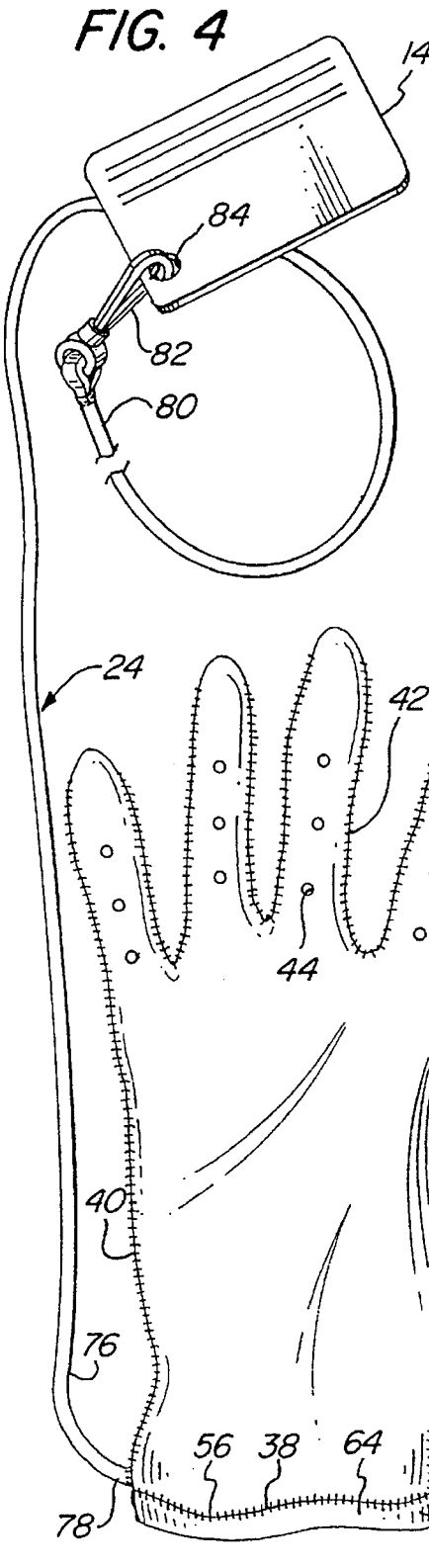
FIG. 4 is a view similar to FIG. 2, but with the slot machine bonus card shown attached to the elastomeric strap of the glove.
Figure 5:
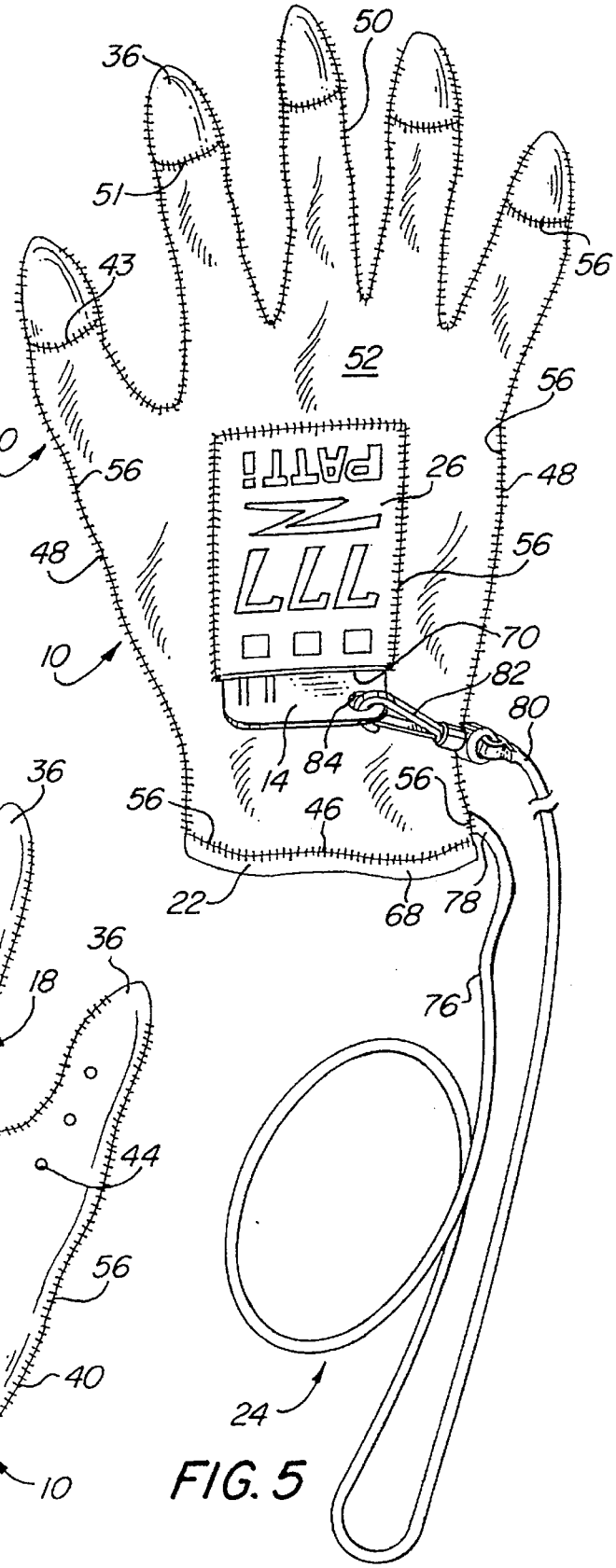
FIG. 5 is a view similar to FIG. 3, but with the slot machine bonus card shown attached to the elastomeric strap of the glove and inserted in the bonus card pocket.
Figure 6:
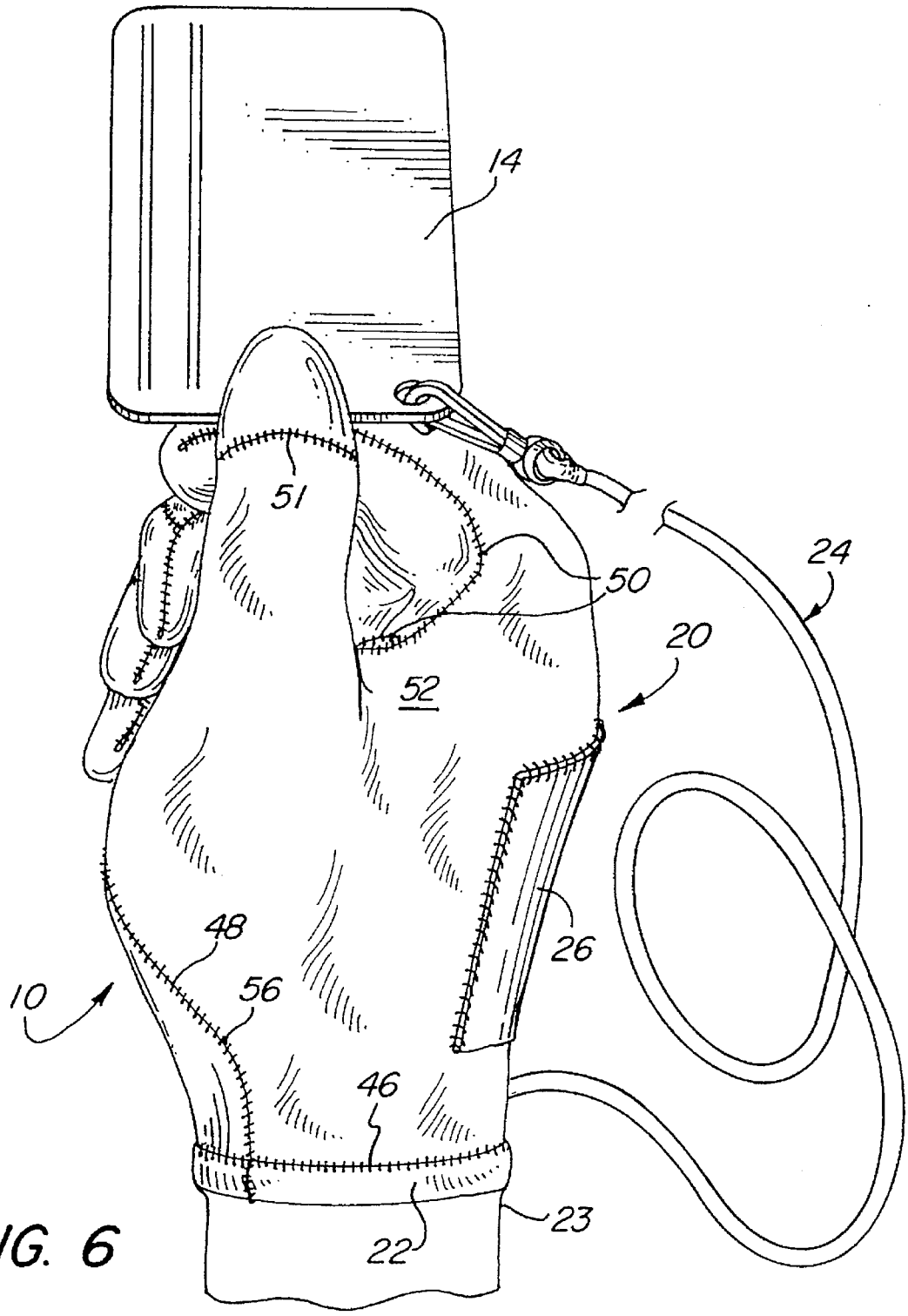
FIG. 6 is a perspective view of the glove of FIG. 1, as seen from the thumb side, and shown holding the bonus card.

Still referring to FIG. 3, the elastomeric strap assembly 24, which connects the glove 10 to the bonus card 14, has an elastomeric strap 76 with a fixed end 78 and a free end 80. The fixed end 78 is fastened to the glove 10, adjacent to the elastomeric wrist band 22, by means of stitching 56. A clasp 82 is fastened to the free end 80 of the strap 76, also by means of stitching 56. The clasp 82 engages an aperture 84 in the bonus card 14 to secure the card 14 to the glove 10 (see FIG. 4). Should the user forget to retrieve the bonus card 14 from the bonus card holder 16, before starting to walk away, the elastomeric strap assembly 24 provides a reminder to retrieve the card 14. The elastomeric nature of the strap 76 provides a shock cord effect, thereby avoiding breakage of the strap 76 or discomfort to the user.

The front glove portion 18 is formed of a higher friction material than the back glove portion 20. By way of example, the front glove portion 18 can be formed of a natural leather, such as Cabretta leather, or else of a synthetic leather, rubber or other similar material. The back glove portion 20 is generally formed of an elastomeric material such as nylon, spandex, LYRCA brand elastic polyurethane fabric or a blend of cotton and either LYRCA brand elastic polyurethane fabric, polyester, or spandex. A typical blend ratio would involve 70% cotton and 30% synthetic material.

The front glove portion 18 is about 0.5 to 0.9 millimeters in thickness, and preferably about 0.7 millimeters in thickness. In this manner, the glove 10 will be light, allowing it to breathe and allowing for sufficient sensitivity to allow for the holding and grasping of coins.

Dimensionally, the glove 10 will be sized as any other glove, but should be snug fitting for adequate control. The elastomeric strap 76 should be approximately 40 inches in length, allowing a user to access adjacent machines with the bonus card 14 if necessary. The elastomeric wrist band 22 will be approximately one half inch in width, and the pocket 26 will be approximately 2 and ½ inches on each side, allowing the bonus card 14 to protrude.

Several variations of the basic embodiment are possible. By way of example, the elastomeric strap 76 can be affixed to the glove 10 by means of a clip or snap, (see FIG. 7 showing a well-known clip construction and known elastomeric strap in coil form) or even hook and loop material. Further, the strap 76 could be fabricated to be contiguous with the elastomeric wrist band 22.

Additionally, the pocket 26 can be replaced with a patch or decal. The pocket, patch or decal would typically be provided with decorative embroidery or printed indicia such as the user's name, a picture of a slot machine, the word "JACKPOT", etc.

Thus, it can be seen from the foregoing detailed specification and attached drawings that the slot machine glove of the present invention will add to the recreational aspect of using a slot machine and also serve as a "good luck" charm. The glove will further protect the user's hand from the discoloration and smell that results from the continual handling of coins. This allows the gambling casino to save on the cost of cleaning supplies, and helps the user of the slot machine to avoid lost time from the floor to repeatedly wash. The glove, itself, however, is washable or dry cleanable.

Another advantage of the glove is that it will help to prevent the loss of the user's bonus card, thereby preventing the inconvenience of searching for the card, or having to have a new one made up.

The slot machine glove also makes it easy for the user to grip coins or the operational parts of the slot machine, while being lightweight and cool when worn, and yet protective of fingernails and jewelry and capable of protecting against the loss of stones from jewelry.

The slot machine glove is easy and convenient to put on and take off. Further, it is simple in construction, inexpensive to manufacture, and capable of a long life of useful service with a minimum of maintenance.

It is obvious that minor changes may be made in the form and construction of the invention without departing from the material spirit thereof. It is not, therefore, desired to confine the invention to the exact form herein shown and described, but it is desired to include all such as properly come within the scope claimed.

The invention having been thus described, what is claimed as new and desired to secure by Letters Patent is:

1. A method of using a glove to operate a slot machine comprising the steps of:

(a) before operating said slot machine, donning on an operating hand a specially adapted glove having an elastomeric strap having a fixed end fixed to said glove and a free end, (b) operatively connecting said free end to a slot machine bonus card, (c) inserting said slot machine bonus card in said slot machine, (d) operating said slot machine, and (e) after operating said slot machine, extracting said bonus card from said slot machine.

2. A method of using a glove to operate a slot machine comprising the steps of:

(a) before operating said slot machine, donning on an operating hand a specially adapted glove having a pocket adapted for receiving a slot machine bonus card on said glove, positioned on an outer surface of a back glove portion, and an elastomeric strap having a fixed end fixed to said glove and a free end, (b) inserting said slot machine bonus card in said pocket, (c) extracting said slot machine bonus card from said pocket, (d) operatively connecting said free end to said slot machine bonus card, (e) inserting said slot machine bonus card in said slot machine, (f) operating said slot machine, (g) after operating said slot machine, extracting said bonus card from said slot machine, and (h) reinserting said bonus card in said pocket.

3. A method of using a glove to operate a slot machine comprising the steps of:

(a) before operating said slot machine, donning on an operating hand, a specially adapted glove comprising:

(1) a front glove portion, formed of leather and being about 0.7 millimeters in thickness, for covering the palm and the palm side of each digit, for extending around the end surface of the tip of each digit, and for covering at least a part of the upper surface of each digit, said front glove portion having a rear peripheral edge, a pair of lateral peripheral edges and a forward peripheral edge, said front glove portion further having a plurality of apertures for ventilation;

(2) a back glove portion, formed of an elastomeric material, for covering the portion of the back of the hand not covered by the front glove portion, said back glove portion having a rear peripheral edge, a pair of lateral peripheral edges, a forward peripheral edge, and an outer surface, said front glove portion and said back glove portion being joined at their lateral peripheral edges and their forward peripheral edges so that said front glove portion is seamless at the end surface of the tip of each digit, and said front glove portion being formed of a higher friction material than said back glove portion;

(3) an elastomeric band attached to both said front glove portion and said back glove portion and extending along the length of the rear peripheral edge of said front glove portion and along the length of the rear peripheral edge of said back glove portion, said elastomeric band being for receiving the wrist of the slot machine player;

(4) a pocket adapted for receiving a slot machine bonus card, said pocket being positioned on the outer surface of said back glove portion;

(5) an elastomeric strap having a fixed end and a free end, said fixed end being attached to said glove and said free end being adapted to be operatively connected to the slot machine bonus card; and (6) a clasp, attached to the free end of said elastomeric strap, said clasp being for operatively connecting said free end to the slot machine bonus card;

(b) inserting said slot machine bonus card in said pocket, (c) extracting said slot machine bonus card from said pocket, (d) operatively connecting said free end of said strap to said bonus card, (e) inserting said bonus card in said slot machine, (f) inserting coins in said slot machine with said operating hand, (g) operating said slot machine with said operating hand, (h) extracting any returning coins from said slot machine with said operating hand, (i) after operating said slot machine, extracting said bonus card from said slot machine, and (j) reinserting said bonus card in said pocket.

4. A method of using a glove to operate a slot machine comprising the steps of:

(a) before operating said slot machine, donning on an operating hand a specially adapted glove comprising:

(1) a front glove portion for covering the palm and the palm side of each digit, for extending around the end surface of the tip of each digit, and for covering at least a part of the upper surface of each digit, said front glove portion having a rear peripheral edge, a pair of lateral peripheral edges and a forward peripheral edge; and (2) a back glove portion, for covering the portion of the back of the hand not covered by the front glove portion, said back glove portion having a rear peripheral edge, a pair of lateral peripheral edges, a forward peripheral edge, and an outer surface, said front glove portion and said back glove portion being joined at their lateral peripheral edges and their forward peripheral edges so that said front glove portion is seamless at the end surface of the tip of each digit, and said front glove portion being formed of a higher friction material than said back glove portion;

(b) inserting coins in said slot machine with said operating-hand, (c) attaching an elastomeric strap having a fixed end and a free end by the fixed end to said glove, (d) operatively connecting said free end to a slot machine bonus card, (e) inserting said slot machine bonus card in said slot machine, (f) operating said slot machine with said operating hand, and (g) extracting any returning coins from said slot machine with said operating hand.

5. A method as recited in claim 4 further comprising the step of:

(h) before operatively connecting said free end to said bonus card, attaching a clasp, attachable to said bonus card, to said free end.

6. A method as recited in claim 4, further comprising the steps of:

(h) attaching a pocket adapted for receiving a slot machine bonus card on said glove, positioned on the outer surface of said back glove portion, and (i) inserting said slot machine bonus card in said pocket, when said bonus card is not in use.

* * * * *